US011175091B2

(12) United States Patent
Goloubev

(10) Patent No.: US 11,175,091 B2
(45) Date of Patent: Nov. 16, 2021

(54) METHOD AND APPARATUS FOR THE CRYOGENIC SEPARATION OF AIR

(71) Applicant: LINDE AKTIENGESELLSCHAFT, Munich (DE)

(72) Inventor: Dimitri Goloubev, Munich (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 760 days.

(21) Appl. No.: 14/789,171

(22) Filed: Jul. 1, 2015

(65) Prior Publication Data

US 2016/0003535 A1 Jan. 7, 2016

(30) Foreign Application Priority Data

Jul. 5, 2014 (EP) ..... 14002310

(51) Int. Cl.
*F25J 3/04* (2006.01)

(52) U.S. Cl.
CPC ..... *F25J 3/04412* (2013.01); *F25J 3/0409* (2013.01); *F25J 3/04054* (2013.01); *F25J 3/04084* (2013.01); *F25J 3/04175* (2013.01); *F25J 3/04296* (2013.01); *F25J 3/04393* (2013.01); *F25J 3/04678* (2013.01); *F25J 3/04727* (2013.01); *F25J 3/04812* (2013.01); *F25J 2205/04* (2013.01); *F25J 2245/50* (2013.01)

(58) Field of Classification Search
CPC ..... F25J 3/04472–04515; F25J 3/04054; F25J 3/048018; F25J 3/0409; F25J 3/04084; F25J 3/04078
See application file for complete search history.

(56) References Cited

U.S. PATENT DOCUMENTS

2005/0126221 A1 6/2005 Ha et al.
2006/0010912 A1* 1/2006 Brugerolle ..... F25J 3/04054 62/643
2009/0064714 A1* 3/2009 Rottmann ..... F25J 3/04054 62/642
2012/0131952 A1* 5/2012 Alekseev ..... F25J 3/04024 62/643
2014/0007617 A1* 1/2014 Le Bot ..... F25J 3/04054 62/643

FOREIGN PATENT DOCUMENTS

EP 2 458 311 A1 5/2012
EP 2 520 886 A1 11/2012

* cited by examiner

*Primary Examiner* — John F Pettitt, III
(74) *Attorney, Agent, or Firm* — Millen White Zelano & Branigan, PC; Brion P. Heaney

(57) ABSTRACT

A method and apparatus serve for the cryogenic separation of air in an air separation plant which has a main air compressor, a main heat exchanger and a distillation column system with a high-pressure column and a low-pressure column. All of the feed air is compressed in the main air compressor to a first air pressure which is at least 3 bar higher than the operating pressure of the high-pressure column. A first part of the compressed total air flow, as first air flow at the first air pressure, is cooled and liquefied or pseudo-liquefied in the main heat exchanger, then expanded and introduced into the distillation column system. A second part of the compressed total air flow, as second air flow, is post-compressed in a turbine-driven post-compressor to a second air pressure.

13 Claims, 1 Drawing Sheet

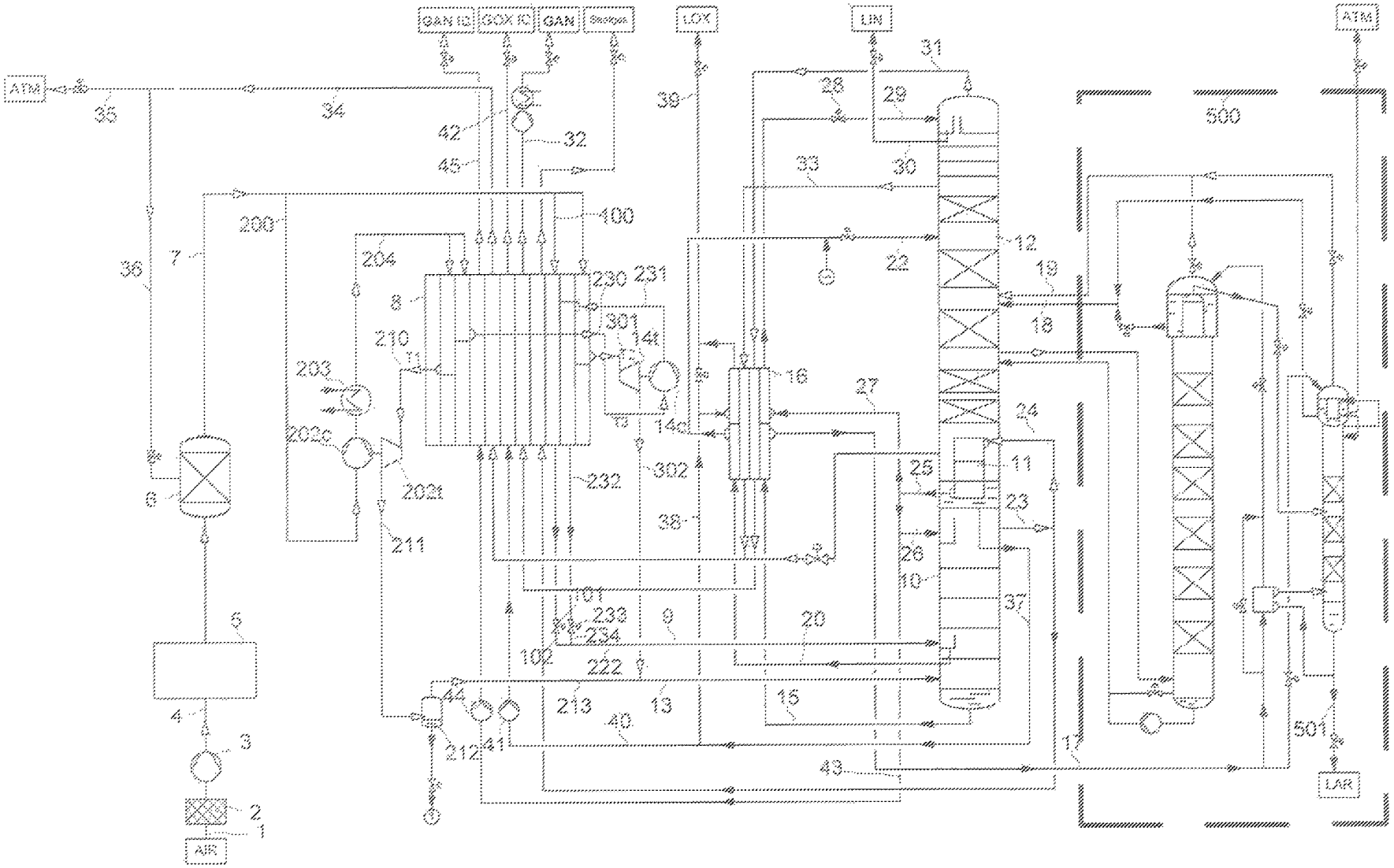
ATM
LIN
LOX
GAN
GAN LIQ
LOX LIQ
500
ATM

METHOD AND APPARATUS FOR THE CRYOGENIC SEPARATION OF AIR

CROSS REFERENCE TO RELATED APPLICATIONS

This application claims priority from European Patent Application EP 14002310.2 filed Jul. 5, 2014.

BACKGROUND OF THE INVENTION

The invention relates to a method for the cryogenic separation of air, in which both at least one liquid product and at least one internally compressed product are obtained, wherein two air turbines are used which drive two post-compressors, one of which is designed as a cold compressor.

A "main air compressor" is in this context understood as a multi-stage machine whose stages have a common drive (electric motor, steam turbine or gas turbine) and are arranged in a common housing. It can for example be formed by a geared compressor in which the stages are grouped around the gearing casing.

This gearing has a large gear which drives multiple parallel pinion shafts with respectively one or two stages.

Methods and apparatuses for the cryogenic separation of air are for example known from Hausen/Linde, Tieftemperaturtechnik [Cryogenics], $2^{nd}$ Edition 1985, Chapter 4 (pages 281 to 337).

The distillation column system of the invention can be designed as a two-column-system (for example as a classic Linde twin-column system), or also as a three- or multi-column-system. In addition to the columns for nitrogen-oxygen-separation, it can have further apparatuses for obtaining high-purity products and/or other air components, in particular noble gases, for example argon production and/or krypton-xenon production.

In the process, a liquid pressurized first product flow is evaporated in the main heat exchanger and then obtained as a pressurized gaseous product. This method is also termed internal compression. In the case of a supercritical pressure, no phase change per se takes place; the product flow is then "pseudo-evaporated".

Counter to the (pseudo-)evaporating product flow, a heat transfer medium at high pressure is liquefied (or, respectively, pseudo-liquefied if it is at a supercritical pressure). The heat transfer medium frequently consists of one part of the air, in the present case in particular of the first and the fourth air flow.

Internal compression methods are for example known from DE 830805, DE 901542 (=U.S. Pat. No. 2,712,738/U.S. Pat. No. 2,784,572), DE 952908, DE 1103363 (=U.S. Pat. No. 3,083,544), DE 1112997 (=U.S. Pat. No. 3,214,925), DE 1124529, DE 1117616 (=U.S. Pat. No. 3,280,574), DE 1226616 (=U.S. Pat. No. 3,216,206), DE 1229561 (=U.S. Pat. No. 3,222,878), DE 1199293, DE 1187248 (=U.S. Pat. No. 3,371,496), DE 1235347, DE 1258882 (=U.S. Pat. No. 3,426,543), DE 1263037 (=U.S. Pat. No. 3,401,531), DE 1501722 (=U.S. Pat. No. 3,416,323), DE 1501723 (=U.S. Pat. No. 3,500,651), DE 253132 (=U.S. Pat. No. 4,279,631), DE 2646690, EP 93448 B1 (=U.S. Pat. No. 4,555,256), EP 384483 B1 (=U.S. Pat. No. 5,036,672), EP 505812 B1 (=U.S. Pat. No. 5,263,328), EP 716280 B1 (=U.S. Pat. No. 5,644,934), EP 842385 B1 (=U.S. Pat. No. 5,953,937), EP 758733 B1 (=U.S. Pat. No. 5,845,517), EP 895045 B1 (=U.S. Pat. No. 6,038,885), DE 19803437 A1, EP 949471 B1 (=U.S. Pat. No. 6,185,960 B1), EP 955509 A1 (=U.S. Pat. No. 6,196,022 B1), EP 1031804 A1 (=U.S. Pat. No. 6,314,755), DE 19909744 A1, EP 1067345 A1 (=U.S. Pat. No. 6,336,345), EP 1074805 A1 (=U.S. Pat. No. 6,332,337), DE 19954593 A1, EP 1134525 A1 (=U.S. Pat. No. 6,477,860), DE 10013073 A1, EP 1139046 A1, EP 1146301 A1, EP 1150082 A1, EP 1213552 A1, DE 10115258 A1, EP 1284404 A1 (=US 2003051504 A1), EP 1308680 A1 (=U.S. Pat. No. 6,612,129 B2), DE 10213212 A1, DE 10213211 A1, EP 1357342 A1 or DE 10238282 A1, DE 10302389 A1, DE 10334559 A1, DE 10334560 A1, DE 10332863 A1, EP 1544559 A1, EP 1585926 A1, DE 102005029274 A1, EP 1666824 A1, EP 1672301 A1, DE 102005028012 A1, WO 2007033838 A1, WO 2007104449 A1, EP 1845324 A1, DE 102006032731 A1, EP 1892490 A1, DE 102007014643 A1, EP 2015012 A2, EP 2015013 A2, EP 2026024 A1, WO 2009095188 A2 or DE 102008016355 A1.

This application describes multiple process parameters such as mass flow rates or pressures, which are "smaller" or "greater" in one mode of operation than in another mode of operation. This refers in this case to targeted changes to the respective parameter by means of regulating and/or setting devices and not to natural variations within a stationary operating state. These targeted changes can be brought about either directly by controlling the parameter itself or indirectly by controlling other parameters which influence the parameter to be changed. In particular, a parameter is then "greater" or, respectively, "smaller" if the difference between the average values of the parameter in the various modes of operation is greater than 2%, in particular greater than 5%, in particular greater than 10%.

In the case of the pressure values, in this case the natural pressure losses are generally not taken into account. Pressures are considered "equal" here if the pressure differences between the corresponding locations are not greater than the natural pipe losses which are caused by pressure losses in pipes, heat exchangers, coolers, adsorbers etc. For example, if the first product flow experiences a pressure loss in the passages of the main heat exchanger, the output pressure of the compressed gas product downstream of the main heat exchanger and the pressure upstream of the main heat exchanger are nonetheless equally termed "the first product pressure" here. Conversely, the second pressure of a flow downstream of certain method steps is then "lower" or "higher" than the first pressure upstream of these steps only if the corresponding pressure difference is higher than the natural pipe losses, that is to say in particular the pressure rise takes place by means of at least one compressor stage or, respectively, the pressure reduction takes place in a targeted manner by means of at least one throttle valve and/or at least one expansion machine (expansion turbine).

The "main heat exchanger" serves for cooling feed air in indirect heat exchange with back flow from the distillation column system. It can be formed of a single or a plurality of parallel- and/or series-connected heat exchanger sections, for example of one or more plate heat exchanger blocks.

The invention is based on the object of indicating a method of the type mentioned in the introduction and an apparatus which can be operated with a highly variable liquid product fraction. In that context, the "liquid product fraction" includes only flows which leave the air separation plant in liquid form and for example are introduced into a liquid tank, but not internally compressed flows which, although they are removed from the distillation column system in liquid form, are however evaporated or pseudo-evaporated within the air separation plant and are then discharged from the air separation plant in the gaseous state.

SUMMARY OF THE INVENTION

This object is achieved by a method for the cryogenic separation of air in an air separation plant which has a main air compressor, a main heat exchanger (8) and a distillation column system with a high-pressure column (10) and a low-pressure column, wherein all of the feed air (1) is compressed in the main air compressor (3) to a first air pressure which is at least 3 bar higher than the operating pressure of the high-pressure column, in order to form a compressed total air flow (4, 7), a first part of the compressed total air flow, as first air flow (100) at the first air pressure, is cooled and liquefied or pseudo-liquefied in the main heat exchanger (8), then expanded (101) and introduced (102, 9) into the distillation column system, a second part of the compressed total air flow, as second air flow (200), is post-compressed in a first turbine-driven post-compressor (202*c*) to a second air pressure which is higher than the first air pressure, a first partial flow of the post-compressed second air flow as third air flow (210) at the second air pressure and at a first temperature (T1) is introduced into a first turbine (202*t*), where it is expanded, performing work, and is then introduced (211, 213, 22) into the distillation column system, wherein the first turbine (202*t*) drives the first turbine-driven post-compressor (202*c*), at least occasionally at least one liquid product (30; 39; LAR) is obtained in the distillation column system and is drawn off from the air separation plant, a first product flow (37; 43) is drawn off in liquid form from the distillation column system, is raised in the liquid state to a first elevated product pressure (41; 44), is evaporated or pseudo-evaporated and heated in the main heat exchanger (8) and the heated first product flow (42; 45) is drawn off from the air separation plant as first compressed gas product, wherein at least occasionally a second partial flow of the post-compressed second air flow as fourth air flow (230) in the main heat exchanger (8) is cooled to a first intermediate temperature (T3), is further compressed in a cold compressor (14*c*) to a third air pressure which is higher than the second air pressure and the further compressed fourth air flow (231) at the third air pressure is cooled and liquefied or pseudo-liquefied in the main heat exchanger (8), then expanded (233) and introduced (234, 9) into the distillation column system, in a first mode of operation a first total quantity of liquid products (30; 39; LAR) is drawn off from the air separation plant, in a second mode of operation a second total quantity of liquid products (30; 39; LAR), which is less than the first total quantity, is drawn off from the air separation plant, and in that the fourth air flow (230), which flows through the cold compressor (14*c*), has at least one of the following properties:

the quantity thereof is greater in the second mode of operation than in the first mode of operation the pressure thereof at the outlet of the cold compressor is higher in the second mode of operation than in the first mode of operation.

The "first mode of operation" of the invention is configured for a particularly high liquid production, in particular for maximum liquid production (total quantity of liquid products which is drawn off from the air separation plant). The "second mode of operation" is, by contrast, configured for a lower liquid product fraction, which can for example also be zero (pure gas operation). In the second mode of operation, the total quantity of liquid products is for example 0%, or somewhat higher, for example between 50% and 100% of the maximum quantity of liquid product. (All percentages relate here and in the following to the molar quantity, unless stated otherwise. The molar quantity can for example be indicated in $Nm^3/h$.)

The method according to the invention uses a turbine-driven cold compressor which is operated in the first mode of operation with a lower load than in the second. At first glance, it does not appear to be productive to operate turbines with a lower throughput during operation with maximum liquid production, since turbines can fundamentally be used for producing the cold for the product liquefaction. Within the context of the invention, it has however been found that this measure makes it possible to achieve a particularly high variation in the liquid product quantity, with satisfactory efficiency being achieved in both modes of operation, thus overall comparably low energy consumption.

A "cold compressor" is in this context understood as a compression device, in which the gas for the compression is supplied at a temperature which is far below ambient temperature, generally below 250 K, preferably below 200 K.

In the method according to the invention, the cold compressor can be driven by an electric motor. In many cases, however, it is expedient to use a turbine-cold compressor combination, at least occasionally a third part of the compressed total air flow as fifth air flow (301) at the first air pressure and at a second temperature (T2) is introduced into a second turbine (14*t*) where it is expanded, performing work, the second turbine (14*t*) drives a second turbine-driven post-compressor which is formed by the cold compressor (14*c*), the fifth air flow (302), which has been expanded, performing work, is introduced (13) into the distillation column system and in that in the first mode of operation the quantity of air which is guided as fifth air flow (301, 302) through the second turbine (14*t*) is less than in the second mode of operation.

The quantity of air which passes as fifth air flow through the second turbine, which drives the cold compressor, is smaller in the first mode of operation than in the second mode of operation. In an extreme example, the turbine-cold compressor combination in the first mode of operation is entirely non-operational, such that the corresponding quantity of air is equal to zero.

The inlet pressure of the second turbine can be approximately equal to the inlet pressure of the first turbine; however, the two inlet pressures are preferably different. In particular, the inlet pressure of the second turbine can be lower than that of the first turbine and can for example be equal to the first air pressure.

It is expedient if in the first mode of operation only a relatively small part of the feed air is compressed to the third, higher air pressure, as in the first mode of operation a first quantity of air of the compressed total air flow forms the first air flow (100) and a second quantity of air of the compressed total air flow forms the second air flow (200)

and in the second mode of operation a third quantity of air of the compressed total air flow, which is equal to or less than the first quantity of air, forms the first air flow (100) and a fourth quantity of air of the compressed total air flow, which is less than the second quantity of air, forms the second air flow (200).

The third air pressure can moreover be higher in the second mode of operation than in the first mode of operation.

In a particularly preferred embodiment, the third air flow is expanded in the first turbine to an outlet pressure which is equal to the operating pressure of the high-pressure column (plus pipe losses).

The outlet pressure of the second turbine can also be equal to the operating pressure of the high-pressure column (plus pipe losses) or can also be below it, for example at the operating pressure of the low-pressure column (plus pipe losses), in that the fifth air flow (301) is expanded in the second turbine (14*t*) to an outlet pressure which is equal to the operating pressure of the high-pressure column (10) and in that in the second mode of operation the fifth air flow (301) is expanded in the second turbine (14*t*) to an outlet pressure which is equal to the operating pressure of the low-pressure column (12).

The third partial flow is then for example introduced into the low-pressure column.

Otherwise, the expanded partial flows can be introduced in part or in full into the high-pressure column, in that in both modes of operation at least one part of at least one of the following air flows is respectively introduced into the high-pressure column (10) downstream of the expansion of said air flow:

first air flow (102), third air flow (211), fourth air flow (234), and in that at least one part of the expanded fifth air flow (302) is introduced (13) into the high-pressure column (10).

A second product flow is drawn off in liquid form from the distillation column system, is raised in the liquid state to a second elevated product pressure, is evaporated or pseudo-evaporated and heated in the main heat exchanger and the heated second product flow is drawn off from the air separation plant as second compressed gas product, wherein in particular the first product flow consists of oxygen (37) from the lower region of the low-pressure column and/or the second product flow consists of nitrogen (43) from the upper region of the high-pressure column or from a top condenser of the high-pressure column.

It is possible in the method for more than one internal compression product to be generated, and also more than two internal compression products. The various internal compression products can differ in terms of their chemical composition (for example oxygen/nitrogen or also oxygen or nitrogen of various purities) or in terms of their pressure, or both.

The invention further relates to an air separation plant in the form of an apparatus for the cryogenic separation of air with a main heat exchanger (8), a distillation column system having a high-pressure column (10) and a low-pressure column, a main air compressor (3) for compressing all of the feed air (1) to a first air pressure which is at least 3 bar higher than the operating pressure of the high-pressure column, in order to form a compressed total air flow (4, 7), means for cooling a first part of the compressed total air flow as first air flow (100) at the first air pressure in the main heat exchanger (8), means for expanding (101) the cooled first air flow and for introducing (102, 9) this air flow into the distillation column system, a first turbine-driven post-compressor (202*c*) for post-compressing a second part of the compressed total air flow as second air flow (200) to a second air pressure which is higher than the first air pressure, a first turbine (202*t*) for the work-performing expansion of a first partial flow of the second air flow as third air flow (210), post-compressed from a first turbine inlet pressure which is greater than the first air pressure but not greater than the third air pressure, wherein the first turbine (202*t*) is coupled to the first turbine-driven post-compressor (202*c*), means for from the second air pressure and a first temperature (T1) introducing (211, 213, 22) into the distillation column system the third partial flow which has been expanded, performing work, means for obtaining at least one liquid product (30; 39; LAR) in the distillation column system and means for drawing off the liquid product from the air separation plant, means for drawing off, in liquid form, a first product flow (37; 43) from the distillation column system, for increasing pressure in the liquid state to a first elevated product pressure (41; 44), for heating in the main heat exchanger (8) and with means for drawing off the heated first product flow (42; 45) as first compressed gas product from the air separation plant, means for cooling a second partial flow of the second air flow as fourth air flow (230) in the main heat exchanger (8) to a first intermediate temperature (T3), a cold compressor (14*c*) for further compressing the fourth air flow to a third air pressure which is higher than the second air pressure, means for cooling the further compressed fourth air flow at the third air pressure in the main heat exchanger (8), means for expanding (233) the cooled fourth air flow and for introducing (234, 9) this air flow into the distillation column system, and with means for switching between a first and a second mode of operation, wherein in a first mode of operation a first total quantity of liquid products (30; 39; LAR) is drawn off from the air separation plant, in a second mode of operation a second total quantity of liquid products (30; 39; LAR) is drawn off from the air separation plant, which is less than the first total quantity, wherein the switching means are designed such that the fourth air flow (230), which flows through the cold compressor (14*c*), has at least one of the following properties:

the quantity thereof is greater in the second mode of operation than in the first mode of operation and the pressure thereof at the outlet of the cold compressor is higher in the second mode of operation than in the first mode of operation.

The apparatus according to the invention can be complemented by apparatus features which correspond to the features of the dependent method claims.

The "means for switching between a first and a second mode of operation" are complex regulating and control devices which, by cooperating, permit at least partially automatic switching between both modes of operation, and are for example an appropriately programmed operating control system.

BRIEF DESCRIPTION OF THE DRAWINGS

The invention, and further details of the invention, are explained in more detail below with reference to an exemplary embodiment of an air separation plant represented schematically in the drawing.

DETAILED DESCRIPTION OF THE INVENTION

The exemplary embodiment of the invention is first explained below with reference to the first mode of operation, which in this case is configured for maximum liquid production. Atmospheric air 1 (AIR) is drawn in, via a filter 2, by a main air compressor 3 and is compressed to a first air pressure of for example 22 bar. Downstream of the main air compressor 3, the compressed total air 4 at the first air pressure is treated in a pre-cooling device 5 and then in a purification device 6. The purified total air 7 is split into a first air flow 100 and a second air flow 200.

The first air flow 100 is cooled in a main heat exchanger 8, from the hot to the cold end, and in that context is (pseudo-)liquefied and then expanded in a throttle valve 101 to approximately the operating pressure of the high-pressure column explained below, which is preferably 5 bar to 7 bar, for example 6 bar. The expanded first air flow 102 is fed, via the line 9, to the distillation column system which has a high-pressure column 10, a main condenser 11, which is designed as a condenser-evaporator, and a low-pressure column 12.

The second air flow 200 is post-compressed in a first turbine-driven post-compressor 202*c* with aftercooler 203 to a second air pressure of for example 28 bar. The post-compressed second air flow 204 is split into a third air flow 210 and a fourth air flow 230.

The third air flow 210 is fed to the hot end of the main heat exchanger 8 and is removed again at a first intermediate temperature T1. The third air flow is fed, at this intermediate temperature and the second air pressure, to a first turbine 202*t* where it is expanded, performing work, to the operating pressure of the high-pressure column 10, which is 5 bar to 7 bar, for example 6 bar. The first turbine 202*t* is mechanically coupled to the first post-compressor 202*c*. The third air flow 211 which has been expanded so as to perform work is introduced into a separator (phase separator) 212 where a small liquid fraction is removed therefrom. It then flows, in purely gaseous form, via the lines 213 and 13 to the sump of the high-pressure column 10. The turbine inlet pressure is in this case equal to the second air pressure.

In the distillation column system, the sump liquid 15 of the high-pressure column is cooled in a countercurrent subcooler 16 and is fed via line 17 to an argon part 500 which will be explained later. Thence, it flows in part in liquid form (line 18) and in part in gaseous form (line 19) at the low-pressure column pressure back out and is introduced at a suitable point into the low-pressure column 12. (If no argon part is present, the subcooled sump liquid is immediately expanded to low-pressure column pressure and introduced into the low-pressure column.)

At least part of the liquid air guided via line 9 into the high-pressure column 10 is removed again via line 18, also cooled in the countercurrent subcooler 16 and is fed to the low-pressure column 12 via valve 21 and line 22.

A first part 24 of the gaseous overhead nitrogen 23 of the high-pressure column 10 is introduced into the liquefaction space of the main condenser 11 where it is essentially entirely liquefied. A first part 26 of the liquid nitrogen 25 so obtained is given up to the high-pressure column 10 as recirculation. A second part 27 is cooled in the countercurrent subcooler 16 and is fed via valve 28 and line 29 to the top of the low-pressure column 12. In the first mode of operation, part of this is removed again via line 30 and is obtained as liquid nitrogen product (LIN) and is drawn off from the air separation plant.

From the top of the low-pressure column, in which there prevails a pressure of 1.2 bar to 1.6 bar, for example 1.3 bar, gaseous low-pressure nitrogen 31 is removed, is heated in the countercurrent subcooler 16 and in the main heat exchanger 8 and is drawn off via line 32 as gaseous low-pressure product (GAN). Gaseous impure nitrogen 33 from the low-pressure column is also heated in the countercurrent subcooler 16 and the main heat exchanger 8. The hot impure nitrogen 34 can either be vented into the atmosphere (ATM) via line 35 or can be used, via line 36, as regeneration gas in the purification device 6.

Liquid oxygen is drawn off, via line 37, from the sump of the low-pressure column 12 (specifically from the evaporation space of the main condenser 11). As the case may be, a first part 38 is subcooled in the countercurrent subcooler 16 and is obtained via line 39 as liquid oxygen product (LOX) and is drawn off from the air separation plant. A second part 40 forms the "first product flow", is raised in a pump 41 to a first product pressure of for example 37 bar, is evaporated at this high pressure in the main heat exchanger 16 and is heated to near ambient temperature. The hot high-pressure oxygen 42 is given off as oxygen-rich first compressed gas product (GOX IC).

A further internal compression product can be obtained from a third part 43 of the liquid nitrogen 25 from the main condenser 11. This is raised as "second product flow" in a pump 44 in liquid form to a second product pressure of for example also 37 bar. At this second product pressure, it is evaporated in the main heat exchanger 8 and heated to near ambient temperature. The hot high-pressure nitrogen 45 is then given off at the second product pressure as nitrogen-rich compressed gas product (GAN IC).

A third part 230 of the second air flow 204 forms a "fourth air flow"; this is cooled in the main heat exchanger (8) to a first intermediate temperature (T3), further compressed in a cold compressor (14*c*) to a third air pressure of for example 40 bar and flows through the main heat exchanger as far as the cold end at this very high pressure. The cold pseudo-liquefied third part 232 is expanded in a throttle valve 233 to the high-pressure column pressure and is fed via the lines 234 and 9 to the high-pressure column 10.

The cold compressor 14*c* is driven by a second expansion turbine 14*t*, in which a third partial flow 301 of the compressed total air flow 7, as "fifth air flow", is expanded so as to perform work from the first air pressure to the operating pressure of the high-pressure column 10. The second turbine has an inlet temperature T2. The fifth air flow 302 expanded so as to perform work is introduced via line 13 into the high-pressure column 10.

If an argon product is required, the air separation plant also has an argon part 500 which functions as described in EP 2447563 A1 and produces a further liquid product in the form of pure liquid argon (LAR) which is drawn off via line 501.

The "first total quantity of liquid products", which is drawn off from the air separation plant in a first mode of operation, consists in this exemplary embodiment of the flows 30 (LIN), 39 (LOX) and 501 (LAR). In the first mode of operation, the ratio of the total quantity of liquid products (LOX, LIN, LAR) to the quantity of oxygen-rich compressed gas product 42 (GOX IC, "first compressed gas product") is between 20% and 30%. The power of the turbine 14*t* is less than 20% of the power of the turbine 202*t*.

In a second mode of operation, the plant is operated with a reduced "second total quantity of liquid products" and reduced ratio of the total quantity of liquid products (LOX, LIN, LAR) to the quantity of oxygen-rich compressed gas product 42 (GOX IC, "first compressed gas product"). In general, the flow quantity is reduced in at least one of the lines 30 and 39, preferably in both. The argon production is generally not restricted in a targeted manner since in most cases the maximum argon yield is desired. The quantities and pressures of the internal compression products 42, 45 also remain constant.

In a variant of the exemplary embodiment represented here, the two turbine inlet temperatures T1 and T2 can also, within the scope of the invention, be identical.

In the second mode of operation, the turbine powers are shifted, the turbine 14*t* is run up, in particular to full load and the power of the turbine 202*t* is reduced. The ratio of the powers of the turbines 14*t*/202*t* is for example below 30%.

Moreover, the total quantity of air and the final pressure of the compressor are reduced, such that the main air compressor 3 uses less energy. The internal compression process is, however, improved by the fact that the fourth and fifth partial flows 230, 301 are increased and thus more high-pressure air 232 is available. The quantity of air through the line 100 is less than or equal to that in the first mode of operation. With the reduction in liquid production when transitioning from the first to the second operation case, the load on the second turbine 14*t* is increased and the load on the first turbine 202*t* is reduced.

Fundamentally, the described process can occasionally also be operated in stationary fashion, that is to say with constant liquid production. In another application case, it can be expedient in the first mode of operation to entirely shut down the combination of second turbine 14*t* and cold compressor 14*c*.

The second turbine 14*t* can also be formed such that it injects not into the high-pressure column 10 but into the low-pressure column 12; by virtue of the correspondingly raised pressure ratio, more energy can be made available for the cold compressor.

The effect of the invention can be further increased by connecting, downstream of the cold compressor 14*c*, a second cold compressor which can be switched off. In the second mode of operation, the flow from the first cold compressor 14*c* is fed through a second cold compressor before it is fed back into the main heat exchanger. The second cold compressor is driven with an electric motor. In the first mode of operation, the second cold compressor is switched off and the flow from the first cold compressor 14*c* flows via a bypass line past the second cold compressor.

What I claim is:

1. A method for cryogenic separation of air in an air separation plant which has a main air compressor, a main heat exchanger and a distillation column system with a high-pressure column and a low-pressure column, said method comprising:

compressing feed air in the main air compressor to a first air pressure, which is at least 3 bar higher than an operating pressure of the high-pressure column, to form a compressed total air flow, splitting, at the first pressure, the compressed total air flow into a first air flow and a second air flow, cooling and liquefying or pseudo-liquefying said first air flow, at the first pressure, in the main heat exchanger, then expanding the first air flow to form an expanded first air flow, and introducing the expanded first air flow into the distillation column system, compressing said second air flow in a first turbine-driven compressor from the first pressure to a second air pressure which is higher than the first air pressure, to form a compressed second air flow, branching off, at the second pressure, a first partial flow of said compressed second air flow to form a third air flow, and introducing said third air flow at the second pressure into a first turbine, where said third air flow is expanded, while performing work, to form an expanded third air flow, and introducing said expanded third air flow into the distillation column system, wherein the first turbine drives the first turbine-driven compressor, producing one or more liquid products in the distillation column system and withdrawing said one or more liquid products from the air separation plant, withdrawing a first product flow in liquid form, from the distillation column system, elevating the pressure of said first product flow in liquid form to a first elevated product pressure, and evaporating or pseudo-evaporating and further heating said first product flow at said first elevated pressure in the main heat exchanger to form a first compressed gas product, withdrawing said first compressed gas product from the air separation plant, forming, at the second pressure, a second partial flow of said compressed second air flow to form a fourth air flow, cooling said fourth air flow in the main heat exchanger at the second pressure to a first intermediate temperature, and further compressing said fourth air flow in a cold compressor to a third air pressure which is higher than the second air pressure, to form a further compressed fourth air flow, cooling and liquefying or pseudo-liquefying said further compressed fourth air flow at the third air pressure in the main heat exchanger, to form a liquefied or pseudo-liquefied fourth air flow, and then expanding said liquefied or pseudo-liquefied fourth air flow to form an expanded fourth air flow, and introducing said expanded fourth air flow into the distillation column system, wherein in a first mode of operation a first quantity of said one or more liquid products is withdrawn from the air separation plant, wherein in the first mode of operation a first ratio of the first quantity of said one or more liquid products to a first quantity of said first compressed gas product is between 20% and 30%, in a second mode of operation a second quantity of said one or more liquid products, which is at least 50% of the first quantity and is less than the first quantity, is withdrawn from the air separation plant, and in both the first mode of operation and the second mode of operation at least a part of one of the following air flows is introduced into the high-pressure column: said expanded first air flow, said expanded third air flow, and said expanded fourth air flow, the fourth air flow, which flows through the cold compressor, has at least one of the following properties:

a quantity thereof is greater in the second mode of operation than in the first mode of operation, and a pressure thereof at an outlet of the cold compressor is higher in the second mode of operation than in the first mode of operation.

2. The method according to claim 1, wherein a fifth air flow is branched off from said first air flow, and at the first air pressure and at a second temperature is introduced into a second turbine where said fifth air flow is expanded, performing work, to form an expanded fifth air flow, the second turbine drives a second turbine-driven compressor which is said cold compressor, said expanded fifth air flow is introduced into the distillation column system, wherein in the first mode of operation a first quantity of said fifth air flow is introduced into the second turbine and in the second mode of operation a second quantity of said fifth air flow is introduced into the second turbine, and the first quantity of said fifth air flow is less than the second quantity of said fifth air flow.

3. The method according to claim 2, wherein in the first mode of operation a first quantity of air forms said first air flow and a second quantity of air forms said second air flow, and in the second mode of operation a third quantity of air, which is equal to or less than the first quantity of air, forms the first air flow, and a fourth quantity of air, which is less than the second quantity of air, forms the second airflow.

4. The method according to claim 1, wherein said third airflow is expanded in the first turbine to an outlet pressure which is equal to the operating pressure of the high-pressure column.

5. The method according to claim 2, wherein said fifth air flow is expanded in the second turbine to an outlet pressure which is equal to the operating pressure of the high-pressure column.

6. The method according to claim 2, wherein, in the second mode of operation, the fifth air flow is expanded in the second turbine to an outlet pressure which is equal to an operating pressure of the low-pressure column.

7. The method according to claim 2, wherein at least one part of the expanded fifth air flow is introduced into the high-pressure column.

8. The method according to claim 1, wherein a second product flow is withdrawn in liquid form from the distillation column system, is raised in the liquid state to a second elevated product pressure, is evaporated or pseudo-evaporated and heated in the main heat exchanger, and the heated second product flow is withdrawn from the air separation plant, wherein the first product flow consists of oxygen from a lower region of the low-pressure column and/or the second product flow consists of nitrogen from an upper region of the high-pressure column or from a top condenser of the high-pressure column.

9. The method according to claim 1, wherein said expanded third airflow is introduced into the high-pressure column.

10. The method according to claim 1, wherein said third air pressure is higher in the second mode of operation than in the first mode of operation.

11. The method according to claim 1, wherein, in the first mode of operation, the cold compressor operates with a lower load than in the second mode of operation.

12. The method according to claim 1, wherein in the second mode of operation a second ratio of the second quantity of said one or more liquid products to a second quantity of said first compressed gas product is reduced compared to said first ratio.

13. The method according to claim 2, wherein in the first mode of operation a power of the first turbine is less than 20% of a power of the second turbine and in the second mode of operation a ratio of the power of the first turbine to the power of the second turbine is less than 30%.

* * * * *